US006890696B2

(12) United States Patent
Farrugia et al.

(10) Patent No.: US 6,890,696 B2
(45) Date of Patent: May 10, 2005

(54) TONER PROCESSES

(75) Inventors: Valerie M. Farrugia, Oakville (CA); Michael S. Hawkins, Cambridge (CA)

(73) Assignee: Xerox Corporation, Stamford, CT (US)

( * ) Notice: Subject to any disclaimer, the term of this patent is extended or adjusted under 35 U.S.C. 154(b) by 154 days.

(21) Appl. No.: 10/446,015

(22) Filed: May 27, 2003

(65) Prior Publication Data

US 2004/0241568 A1 Dec. 2, 2004

(51) Int. Cl.[7] ..... G03G 5/00
(52) U.S. Cl. ..... 430/137.14; 430/137.12
(58) Field of Search ..... 430/137.14, 137.12

(56) References Cited

U.S. PATENT DOCUMENTS

| | | | | |
|---|---|---|---|---|
| 4,558,108 | A | 12/1985 | Alexandru et al. | 526/340 |
| 4,797,339 | A | 1/1989 | Maruyama et al. | 430/109 |
| 4,837,100 | A | 6/1989 | Murofushi et al. | 430/106.6 |
| 4,983,488 | A | 1/1991 | Tan et al. | 430/137 |
| 4,996,127 | A | 2/1991 | Hasegawa et al. | 430/109 |
| 5,593,807 | A | 1/1997 | Sacripante et al. | 430/137 |
| 5,604,076 | A | 2/1997 | Patel et al. | 430/137 |
| 5,648,193 | A | 7/1997 | Patel et al. | 430/137 |
| 5,658,704 | A | 8/1997 | Patel et al. | 430/137 |
| 5,660,965 | A | 8/1997 | Mychajlowskij et al. | 430/137 |
| 5,840,462 | A | 11/1998 | Foucher et al. | 430/137 |
| 5,843,614 | A | 12/1998 | Shinzo et al. | 430/137 |
| 5,853,944 | A | 12/1998 | Foucher et al. | 430/137 |
| 5,910,387 | A | 6/1999 | Mychajlowskij et al. | 430/110 |
| 5,916,725 | A | 6/1999 | Patel et al. | 430/137 |
| 5,919,595 | A | 7/1999 | Mychajlowskij et al. | 430/137 |
| 5,925,488 | A | 7/1999 | Patel et al. | 430/137 |
| 5,945,245 | A | 8/1999 | Mychajlowskij et al. | 430/137 |
| 5,977,210 | A | 11/1999 | Patel et al. | 523/161 |
| 6,132,924 | A | 10/2000 | Patel et al. | 430/137 |
| 2002/0187415 | A1 | 12/2002 | Jiang et al. | 430/137.14 |
| 2002/0187416 | A1 | 12/2002 | Jiang et al. | 430/137.14 |
| 2003/0059704 | A1 | 3/2003 | Vanbesien et al. | 430/137.14 |

FOREIGN PATENT DOCUMENTS

EP 0 928 995 A2 7/1999

OTHER PUBLICATIONS

Copending U.S. Appl. No. 10/260,377, filed Sep. 27, 2002, on "Toner Processes" by Reza Stegamat et al.

*Primary Examiner*—Mark A. Chapman
(74) *Attorney, Agent, or Firm*—E. O. Palazzo

(57) ABSTRACT

A toner process comprising heating a mixture of a latex and a colorant, which heating is accomplished below about the glass transition temperature, Tg, of polymer contained in the latex; cooling; and subsequently adding a methacrylate polymer solution; adjusting the pH of the mixture resulting to permit the methacrylate polymer to precipitate on said mixture of latex and said colorant; and wherein resulting product is heated above about the glass transition temperature, Tg, of said latex polymer.

41 Claims, No Drawings

TONER PROCESSES

PENDING APPLICATIONS AND PATENTS

Illustrated in copending application U.S. Ser. No. 10/261,129, entitled Toners and Developers, filed Sep. 27, 2002, the disclosure of which is totally incorporated herein by reference, is a toner comprising at least one binder in an amount of from about 85 to about 99 percent by weight, at least one colorant in an amount of from about 0.5 to about 15 percent by weight, and calcium stearate in an amount of from about 0.05 to about 2 percent by weight, and wherein following triboelectric contact with carrier particles, the toner has a charge Q measured in femtocoulombs per particle diameter D measured in microns (Q/D) of from about −0.1 to about −1 fC/$\mu$m with a variation during development of from about 0 to about 0.25 fC/$\mu$m, and wherein the distribution is substantially unimodal and possesses a peak width of from about 0.1 fC/$\mu$m to about 0.5 fC/$\mu$m and the toner possesses a charge to mass M, as measured in grams, ratio (Q/M) of from about −25 to about −70 $\mu$C/gram with variation of Q/M during development of from about 0 to about 15 $\mu$C/gram.

In U.S. Pat. No. 6,132,924, the disclosure of which is totally incorporated herein by reference, there is illustrated a process for the preparation of toner comprising mixing a colorant, a latex, and two coagulants, followed by aggregation and coalescence, and wherein one of the coagulants may be polyaluminum chloride.

Illustrated in copending application U.S. Ser. No. 10/086,063, entitled Toner Processes, filed Mar. 1, 2002, the disclosure of which is totally incorporated herein by reference, is a process comprising heating a latex, a colorant dispersion, a polytetrafluoroethylene dispersion, and an organo metallic complexing component.

Illustrated in U.S. Pat. No. 5,945,245, the disclosure of which is totally incorporated herein by reference, is a process for the preparation of toner compositions comprising:

(i) preparing an emulsion latex comprised of sodio sulfonated polyester resin particles of from about 5 to about 500 nanometers in size diameter, by heating said resin in water at a temperature of from about 65° C. to about 90° C.;

(ii) preparing a pigment dispersion in water by dispersing in water from about 10 to about 25 weight percent of sodio sulfonated polyester, and from about 1 to about 5 weight percent of pigment;

(iii) adding the pigment dispersion to a latex mixture comprised of sulfonated polyester resin particles in water with shearing, followed by the addition of an alkali halide in water until aggregation results, as indicated by an increase in the latex viscosity of from about 2 centipoise to about 100 centipoise;

(iv) heating the resulting mixture at a temperature of from about 45° C. to about 55° C., thereby causing further aggregation and enabling coalescence, resulting in toner particles of from about 4 to about 9 microns in volume average diameter and with a geometric distribution of less than about 1.3; and optionally (v) cooling the product mixture to about 25° C. and followed by washing and drying.

Disclosed in copending application U.S. Ser. No. 10/260,377, entitled Toner Processes, filed Sep. 27, 2002, the disclosure of which is totally incorporated herein by reference, is a process comprising heating a sulfonated polyester resin latex and a colorant below about the glass transition temperature (Tg) of the sulfonated polyester resin, adding a metal stearate to the resulting slurry, and isolating the product, and wherein the heating generates an alkyl carboxylate metal salt component ionically attached to the surface of the product.

In embodiments of the present invention there may be selected the appropriate components, and processes of the above copending applications and patents.

BACKGROUND

The present invention is directed to a toner process, and more specifically, to chemical toner processes which involve the aggregation and fusion of latex, colorant like pigment or dye, a metal oxide, a commercially available methacrylate copolymer, available from Rohm American Inc. as EUDRAGIT™, and optional additive particles.

More specifically, in embodiments the present invention relates to toner processes wherein there results a toner with a positive charge, triboelectric charge stability to a variety of environmental conditions, excellent developer aging characteristics, reduced excessive negative C-zone charge to thereby provide excellent toner relative humidity (RH) sensitivity, excellent flowing toners and toners free or substantially free of undesirable clumping, and wherein a toner slurry is admixed with the EUDRAGIT™ (EEPO) and wherein after pH adjustments the EEPO is precipitated on the toner surface and forms a thin film or layer of a positively charged polymer of EEPO around the toner surface.

The toners generated with the processes of the present invention can be selected for copying and printing processes, including high speed highlight color systems, trilevel color xerography, color processes, and for a number of known imaging processes, and which toners can provide, for example, high quality colored images, including excellent developed custom color images with excellent image resolution, acceptable signal-to-noise ratio, and image uniformity. Also, the toners obtained with the processes illustrated herein can be specifically selected for digital imaging systems and processes.

REFERENCES

In xerographic systems, especially color systems, small sized toners of, for example, from about 2 to about 10 microns can be of value to the achievement of high image quality for process color applications; obtaining a low image pile height to eliminate, or minimize image feel and avoid paper curling after fusing. Paper curling can exist in xerographic color processes primarily because of the presence of relatively high toner coverage as a result of the application of three to four color toners. During fusing, moisture escapes from the paper due to high fusing temperatures of from about 120° C. to about 200° C. In the situation wherein only one layer of toner is selected, such as in one-color black or highlight color xerographic applications, the amount of moisture driven off during fusing can be reabsorbed by the paper, and the resulting print remains relatively flat with minimal paper curl. In process color where toner coverage is high, the relatively thick toner plastic covering on the paper can inhibit the paper from reabsorbing the moisture, and cause substantial paper curling. These and other imaging shortfalls and problems are avoided or minimized with the toners and processes of the present invention.

Also, it may be useful to select certain toner particle sizes, such as from about 2 to about 10 microns, with a high colorant, especially pigment loading, such as from about 4 to about 15 percent by weight of toner, so that the mass of toner selected for attaining the desired optical density and color gamut can be reduced to eliminate or minimize paper curl. Lower toner mass also can ensure the achievement of image uniformity. However, higher pigment loadings often adversely affect the charging behavior of toners. For example, the charge levels may be too low for proper toner development or the charge distributions may be too wide and toners of wrong charge polarity may be present. Furthermore, higher pigment loadings may also result in the sensitivity of toner charging behavior to charges in environmental conditions, such as temperature and humidity. Toners prepared in accordance with the processes of the present invention minimize, or avoid these disadvantages in embodiments.

There is illustrated in U.S. Pat. No. 4,996,127, the disclosure of which is totally incorporated herein by reference, a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, the disclosure of which is totally incorporated herein by reference, there is disclosed a process for the preparation of toners by the polymerization of a polymerizable monomer dispersed by emulsification in the presence of a colorant and/or a magnetic powder to prepare a principal resin component, and then effecting coagulation of the resulting polymerization liquid in such a manner that the particles in the liquid after coagulation have diameters suitable for a toner. In U.S. Pat. No. 4,797,339, the disclosure of which is totally incorporated herein by reference, there is disclosed a process for the preparation of toners by resin emulsion; and in U.S. Pat. No. 4,558,108, the disclosure of which is totally incorporated herein by reference, there is disclosed a process for the preparation of a copolymer of styrene and butadiene by specific suspension polymerization processes.

Polyester based chemical toners substantially free of encapsulation are illustrated in U.S. Pat. No. 5,593,807, the disclosure of which is totally incorporated herein by reference, wherein there is disclosed a process for the preparation of a toner comprised of a sodio sulfonated polyester resin and pigment, and wherein the aggregation and coalescence of resin particles is mediated with an alkali halide. Other U.S. patents that may be of interest, the disclosures of which are totally incorporated herein by reference, are U.S. Pat. Nos. 5,853,944; 5,843,614; 5,840,462; 5,604,076; 5,648,193; 5,658,704; and 5,660,965.

In U.S. Pat. No. 4,837,100, there is illustrated, for example, an electrophotographic developer comprising a carrier, toner particles positively chargeable by friction with the carrier, fine particles of hydrophilic alumina and fine particles of one of tin oxide, hydrophobic silica and titanium dioxide and wherein the hydrophilic alumina fine particles are present in an amount of from about 0.1 to 3 percent by weight based on the weight of toner particles.

Emulsion/aggregation/coalescence processes for the preparation of toners are illustrated in a number of Xerox Corporation patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; 5,858,601, and 5,977,210. The appropriate components and processes of the above Xerox Corporation patents can be selected for the processes of the present invention in embodiments thereof.

With respect to the references, only a part thereof has been selected and this part may or may not be fully representative of the teachings or disclosures.

SUMMARY

It is a feature of the present invention to provide toner processes with many of the advantages illustrated herein.

In another feature of the present invention there are provided simple and economical processes for the preparation of black and colored toner compositions with excellent colorant dispersions, thus enabling the achievement of excellent color print quality; and a simple and economical chemical process for the preparation of toner compositions.

Additionally, another feature of the present invention resides in a process capable of delivering differing toner morphology particles, such as spherically shaped toner particles.

Moreover, in another feature of the present invention there are provided emulsion, aggregation, coalescence processes wherein, for example, the positively charging toner obtained has incorporated during the process, that is, for example, prior to or subsequent to aggregation and coalescence, a methacrylate copolymer, available from Rohm American Inc. as EUDRAGIT™.

Aspects of the present invention relate to a toner process comprising heating a mixture of a latex and a colorant, which heating is accomplished below about the glass transition temperature, Tg, of polymer contained in the latex; cooling; and subsequently adding a methacrylate polymer solution; adjusting the pH of the mixture resulting to permit the methacrylate polymer to precipitate on said mixture of latex and said colorant; A toner process comprising heating a mixture of a latex and a colorant, which heating is accomplished below about the glass transition temperature, Tg, of polymer contained in the latex; cooling; and subsequently adding a methacrylate polymer solution; adjusting the pH of the mixture resulting to permit the methacrylate polymer to precipitate on said mixture of latex and said colorant; and wherein resulting product is heated above about the glass transition temperature, Tg, of said latex polymer; a toner process comprising heating a mixture of a latex and a colorant, which heating is accomplished below about the glass transition temperature, Tg, of polymer contained in the latex; cooling; and subsequently adding a methacrylate polymer solution; adjusting the pH of the mixture resulting to permit said methacrylate to form on said mixture of said latex and said colorant; and wherein resulting product is heated above about the glass transition temperature, Tg, of said latex polymer; a process wherein the latex is a latex emulsion comprised of resin, water, and an ionic surfactant, and wherein the colorant mixture is a dispersion containing a colorant, water, and an ionic surfactant; a process wherein there is selected for the ionic surfactant a nonionic surfactant; a process wherein the methacrylate copolymer, available from Rohm American Inc. as EUDRAGIT™, is selected in an amount of from about 1 to about 10 percent by weight of the toner components; a process wherein the methacrylate copolymer, available from Rohm American Inc. as EUDRAGIT™, is selected in an amount of from about 3 to about 7 percent by weight; a process wherein each of the surfactants is selected in an amount of from about 1 to about 10 percent by weight based on the toner components amounts; a process wherein there can optionally be added to the toner mixture a second latex, and which latex is comprised of submicron resin particles suspended in an aqueous phase containing an ionic surfactant, and wherein the second latex is optionally selected in an amount of from about 10 to about 40 percent by weight of the initial latex; a process wherein the temperature below about the latex resin Tg is from about 40° C. to about 60° C., thereby resulting in toner aggregates, and the temperature above about the latex resin Tg is from about 75° C. to about 97° C.; a process wherein the temperature at which the aggregation is accomplished controls the size of the aggregates, and wherein the toner isolated is from about 2 to about 15 microns in volume average diameter; a process wherein the colorant is a pigment; a process wherein the latex contains a polyester, such as polyester SPE2, available from Hercules Chemical; a toner and processes thereof wherein the polyester is of the formula

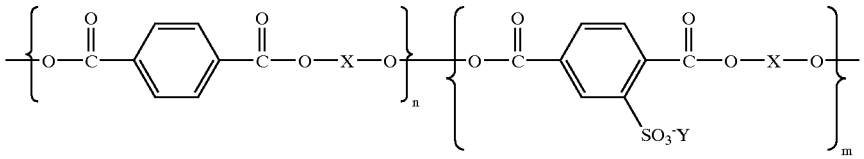

wherein Y is an alkali metal, X is a glycol, and n and m each represent the number of segments; a toner wherein the polyester is a sodiosulfonated polyester; a toner wherein the polyester is present in an amount of from about 80 to about 98 percent by weight of the toner, the colorant is present from an amount of from about 2 to about 20 percent by weight of the toner, and wherein the methacrylate copolymer, available from Rohm American Inc. as EUDRAGIT™, is present on the surface of the toner in an amount of from about 2 to about 7 percent by weight, and wherein the total of all the toner components is about 100 percent; a toner wherein the polyester resin contains from about 0.1 to about 5 percent by weight of sulfonated groups; a toner wherein the methacrylate copolymer, available from Rohm American Inc. as EUDRAGIT™, primarily functions to enhance the toner triboelectric charge and reduce the toner relative humidity sensitivity; a process for the preparation of toner comprising mixing a methacrylate copolymer, available from Rohm American Inc. as EUDRAGIT™, with a latex and a colorant mixture comprised of colorant, and an ionic surfactant; heating the resulting mixture below about the glass transition temperature (Tg) of the latex resin; heating above about the Tg of the latex resin; or alternatively adding the methacrylate copolymer, available from Rohm American Inc. as EUDRAGIT™, particles, which particles can function as a charge enhancing additive, after the aforementioned two heatings and optionally isolating the toner, and wherein the methacrylate copolymer resides on the surface of the toner; a process wherein the latex is a latex emulsion comprised of resin, water, and an ionic surfactant, and wherein the colorant mixture is a dispersion containing a colorant, water, and an ionic surfactant; a process wherein there is selected for the ionic surfactant a nonionic surfactant; a process wherein each of the surfactants is selected in an amount of from about 1 to about 7 percent by weight based on the toner component amounts; a process wherein there can optionally be added to the mixture illustrated a second latex, and which latex is comprised of resin particles suspended in an aqueous phase containing an ionic surfactant, and wherein the second latex is selected in an amount of from about 15 to about 25 percent by weight of the initial latex; a process wherein the temperature about below the latex resin Tg is from about 40° C. to about 60° C., thereby resulting in toner aggregates, and the temperature above about the latex resin Tg is from about 77° C. to about 95° C.; a process wherein the latex resin is selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid); a process wherein the colorant is carbon black, cyan, yellow, magenta, or mixtures thereof, and the toner isolated is from about 2 to about 25 microns in volume average diameter, and the particle size distribution thereof is optionally from about 1.15 to about 1.30, and wherein there is optionally added to the surface of the formed toner metal salts, metal salts of fatty acids, silicas, metal oxides, or mixtures thereof, each in an amount, for example, of from about 0.1 to about 10 percent by weight of the obtained toner; a process wherein the colorant is a colorant dispersion comprised of (i) colorant, water, an ionic surfactant, a nonionic surfactant or mixtures of an ionic surfactant, and a nonionic surfactant; the latex is a latex emulsion; and wherein the (ii) colorant dispersion is blended with the latex emulsion comprised of resin, a nonionic surfactant and an ionic surfactant, and optionally adding a wax dispersion comprised, for example, of submicron wax particles in the diameter of from about 0.1 to about 0.4 micron dispersed in an ionic surfactant of the same charge polarity as that of the ionic surfactant in the colorant dispersion or latex emulsion;

(iii) heating the resulting mixture below about, or about equal to the glass transition temperature (Tg) of the latex resin to form toner sized aggregates;

(iv) heating the resulting aggregate suspension above about the Tg of the latex resin; adding a methacrylate copolymer, available from Rohm American Inc. as EUDRAGIT™, and isolating the toner, which toner contains the methacrylate copolymer on the surface thereof; a process for the preparation of toner comprising (i) providing or generating a latex emulsion of resin, water, and an ionic surfactant, and providing or generating a colorant dispersion containing a colorant, water, an ionic surfactant, or a nonionic surfactant;

(ii) optionally providing or generating a wax dispersion containing an anionic surfactant similarly charged to that of the latex surfactant emulsion;

(iii) blending (ii) with the colorant dispersion;

(iv) heating the resulting mixture below the glass transition temperature (Tg) of the latex resin;

(v) heating (vii) above about the Tg of the latex resin;

(vi) followed by the addition of a methacrylate copolymer, available from Rohm American Inc. as EUDRAGIT™, in an amount of from about 3 to about 7 percent by weight;

(vii) retaining the mixture (vi) at a temperature of from about 70° C. to about 95° C. for about 3 to about 10 hours;

(viii) washing the resulting toner slurry; and (ix) isolating the toner; a process wherein the added latex contains the same resin as the initial latex of (i), or wherein the added latex contains a dissimilar resin than that of the initial latex resin (i); a process wherein aggregation of latex resin and colorant is accomplished by heating at a temperature below the glass transition temperature of the resin or polymer contained in the latex, and coalescence is accomplished by heating at a temperature of above the glass transition temperature of the polymer contained in the latex (i) to enable fusion or coalescence of colorant and latex resin, followed by the mixing of the composition resulting with a methacrylate copolymer; a process wherein the aggregation temperature is from about 45° C. to about 55° C., and the coalescence temperature is from about 75° C. to about 95° C.; a process wherein the latex emulsion comprises submicron resin particles of a diameter of about 100 to about 500 nanometers, and more specifically, in the size range of about 150 to about 400 nanometers in water and an ionic surfactant, and more specifically, an anionic surfactant; the colorant dispersion comprises submicron pigment particles of about 50 to about 250 nanometers, and more specifically, of about 80 to about 200 nanometers in size diameter; a toner process wherein the cationic surfactant comprises, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, and which coagulant surfactant component is selected in an amount of, for example, from about 0.01 to about 10 percent by weight of toner; a process wherein there is added during or subsequent to (v) a second latex, and which latex is comprised of submicron resin particles suspended in an aqueous phase containing an ionic surfactant, and wherein the second latex is optionally selected in an amount of about 15 to about 35 percent by weight of the initial latex; a process wherein the second latex (vi) is added and enables formation of a coating on the resulting toner aggregates of (v), and wherein the thickness of the formed coating is from about 0.1 to about 1 micron; a process wherein the aggregation temperature is from about 50° C. to about 60° C., and the coalescence temperature is from about 80° C. to about 95° C.; a process wherein the latex (i) or added latex contains a resin selected from the group consisting of a number of suitable know resins, or polymers, and more specifically poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid); a process wherein the toner colorant is carbon black, cyan, yellow, magenta, or mixtures thereof, and the toner isolated is from about 1 to about 25 microns in volume average diameter, and the particle size distribution thereof is optionally from about 1.15 to about 1.30; and wherein there is added to the surface of the formed toner metal salts, metal salts of fatty acids, silicas, metal oxides, or mixtures thereof, each in an amount of from about 0.1 to about 3 percent by weight of the obtained toner.

Examples of polyester resins are as indicated herein and in the appropriate U.S. patents recited herein, and more specifically, examples of a number of polyesters that can be selected are copoly(1,2-propylene-dipropylene-5-sulfoisophthalate)-copoly(1,2-propylene-dipropylene terephthalate), copoly(1,2-propylene-diethylene-5-sulfoisophthalate)-copoly(1,2-propylene-diethylene terephthalate), copoly(propylene-5-sulfoisophthalate)-copoly(1,2-propylene terephthalate), copoly(1,3-butylene-5-sulfoisophthalate)-copoly(1,3-butylene terephthalate), copoly(butylenesulfoisophthalate)-copoly(1,3-butylene terephthalate), and the like.

The methacrylate copolymers, available from Rohm American Inc. as, for example, EUDRAGIT™, and more specifically, butylmethacrylate-(2-dimethylaminoethyl) methacrylate-methylmethacrylate copolymer (1:2:1), can be dispersed in water. The copolymer possesses an average particle size diameter of, for example, from about 50 to about 500 nanometers, and more specifically, from about 100 to about 300 nanometers. Examples of specific polymers that may be selected are EUDRAGIT™ RL and RS (Rohm Pharma) which are copolymers believed synthesized from acrylic and methacrylic esters with quaternary ammonium groups. EUDRAGIT™ RL and RS differ in the molar ratios of the ammonium groups to the remaining neutral (meth)acrylic acid esters, about 1:20 and about 1:40, respectively. EUDRAGIT™ NE is an aqueous dispersion of a neutral copolymer based on ethyl acrylate and methyl methacrylate. EUDRAGIT™ RD 100 is the powder form of copolymers of acrylates and methacrylates with a quaternary ammonium group in combination with sodium carboxymethylcellulose.

More specifically, of value with the processes of the present invention is the use of a particular cationic polymer, EEPO, which is reversibly soluble-insoluble in an aqueous solution when the pH is changed, therefore, the solubility of EEPO can be considered pH dependent. The EEPO becomes water soluble via salt formation with acids and can be added in this form to the acidic toner slurry. It is hypothesized that the water soluble polymer would interact in solution with the toner particles even at low pH. Once the polymer has time to adsorb on the toner particles, the pH can be shifted to basic conditions. At this point the polymer will precipitate onto the toner's surface and form a film around the toner upon the evaporation of water. The surface of the toner is hypothesized to acquire the cationic characteristics of the polymer resulting in a positively charged toner. More specifically, in embodiments the EEPO polymer contains tertiary amino functional groups capable of ionic interactions with, for example, sulfonated groups on the surface of the polyester toner. The neighboring polymer chain and toner particle surface become complexed to one another resulting in a modification of the properties of the particle surface and thus the tribocharging characteristics. The surface treatment approach in embodiments is to add the polymer in its dissolved form to the toner slurry following the toner fabrication process. The toner slurry is adjusted to pH of, for example, from about 2 to about 3 to permit the EEPO to remain dissolved during the addition period. Also, it is hypothesized that the water-soluble polymer interacts with the toner particles via electrostatic attraction, even at low pH, and will not substantially precipitate or irreversibly complex to each other. Once the pH is increased to from about 10 to about 12, the EEPO will precipitate onto the toner surface and form a film or layer of positive-charged polymeric material around the toner surface. Evaporating the water from the toner by, for example, freeze drying the toner particles promotes further coalescence of the polymeric film to the toner surface.

Various known colorants, especially pigments, present in the toner in an effective amount of, for example, from about 1 to about 65, and more specifically, from about 2 to about 35 percent by weight of the toner, and more specifically, in an amount of from about 1 to about 15 percent by weight, and wherein the total of all toner components is about 100 percent, include carbon black like REGAL 330®; magnetites such as Mobay magnetites MO8029™, MO8060™; and the like. As colored pigments, there can be selected known cyan, magenta, yellow, red, green, brown, blue or mixtures thereof. Specific examples of colorants, especially pigments, include phthalocyanine HELIOGEN BLUE L6900™, D6840™, D7080™, D7020™, Cyan 15:3, Magenta Red 81:3, Yellow 17, the pigments of U.S. Pat. No. 5,556,727, the disclosure of which is totally incorporated herein by reference, and the like. Examples of specific magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of specific cyans that may be selected include copper tetra (octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative specific examples of yellows that may be selected are Diarylide Yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components, may also be selected as pigments with the process of the present invention. The colorants, such as pigments, selected can be flushed pigments as indicated herein.

More specifically, colorant examples include Pigment Blue 15:3 having a Color Index Constitution Number of 74160, Magenta Pigment Red 81:3 having a Color Index Constitution Number of 45160:3, Yellow 17 having a Color Index Constitution Number of 21105, and known dyes such as food dyes, yellow, blue, green, red, magenta dyes, and the like. Colorants include pigments, dyes, mixtures of pigments, mixtures of dyes, mixtures of dyes and pigments, and the like, and preferably pigments.

Dry powder additives that can be added or blended onto the surface of the toner compositions preferably after washing or drying include, for example, metal salts, metal salts of fatty acids, colloidal silicas, metal oxides like titanium, tin and the like, mixtures thereof and the like, which additives are each usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and flow aids, such as fumed silicas like AEROSIL R972® available from Degussa, or silicas available from Cabot Corporation or Degussa Chemicals, the coated silicas of U.S. Pat. No. 6,004,714 and U.S. Pat. No. 6,190,815, the disclosures of which are totally incorporated herein by reference, and the like, each in amounts of from about 0.1 to about 2 percent, which can be added during the aggregation process or blended into the formed toner product.

Developer compositions can be prepared by mixing the toners with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,990, the disclosure of which is totally incorporated herein by reference.

With further respect to the present invention, in embodiments thereof illustrative examples of resin, polymer or polymers selected for the process of the present invention and present in the latex (i) or added latex include known polymers as illustrated herein, such as acrylates, methacrylates, polyesters like poly(styrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly (styrene-butyl acrylate-acrylonitrile-acrylic acid), poly (acrylonitrile-butyl acrylate-acrylic acid), and the like; the latex polymer, or resin is generally present in the toner compositions in various suitable amounts, such as from about 75 to about 98 percent by weight, or from about 80 to about 95 percent by weight of the toner or of the solids, and the latex size suitable for the processes of the present invention can be, for example, from about 0.05 micron to about 0.5 micron in volume average diameter as measured by the Brookhaven nanosize particle analyzer. Other sizes and effective amounts of latex polymer may be selected in embodiments. The total of all toner components, such as resin, calcium stearate, and colorant, is about 100 percent, or about 100 parts.

The polymer selected for the process of the present invention can be prepared by emulsion polymerization methods, and the monomers utilized in such processes include, for example, styrene, acrylates, methacrylates, butadiene, isoprene, acrylic acid, methacrylic acid, itaconic acid, beta carboxy ethyl acrylate, acrylonitrile, and the like. Known chain transfer agents, for example dodecanethiol, from, for example, about 0.1 to about 10 percent, or carbon tetrabromide in effective amounts, such as for example from about 0.1 to about 10 percent, can also be utilized to control the molecular weight properties of the polymer when emulsion polymerization is selected. Other processes of obtaining polymer particles of from, for example, about 0.01 micron to about 2 microns can be selected from polymer microsuspension process, such as disclosed in U.S. Pat. No. 3,674,736, the disclosure of which is totally incorporated herein by reference; polymer solution microsuspension process, such as disclosed in U.S. Pat. No. 5,290,654, the disclosure of which is totally incorporated herein by reference, mechanical grinding processes, or other known processes.

Examples of optional waxes include those as illustrated herein, polypropylenes and polyethylenes commercially available from Allied Chemical and Petrolite Corporation, wax emulsions available from Michaelman Inc. and the Daniels Products Company, EPOLENE N-15™ commercially available from Eastman Chemical Products, Inc., VISCOL 550-P™, a low weight average molecular weight polypropylene available from Sanyo Kasei K.K., and similar materials. The commercially available polyethylenes selected possess, it is believed, a molecular weight Mw of from about 1,000 to about 1,500, while the commercially available polypropylenes utilized for the toner compositions of the present invention are believed to have a molecular weight of from about 4,000 to about 5,000. Examples of functionalized waxes include amines, amides, for example AQUA SUPERSLIP 6550™, SUPERSLIP 6530™ available from Micro Powder Inc., fluorinated waxes, for example POLYFLUO 190™, POLYFLUO 200™, POLYFLUO 523XF™, AQUA POLYFLUO 411™, AQUA POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, chlorinated polypropylenes and polyethylenes available from Allied Chemical and Petrolite Corporation and SC Johnson wax.

Examples of initiators for the latex preparation include water soluble initiators, such as ammonium and potassium persulfates, in suitable amounts, such as from about 0.1 to about 8 percent, and more specifically, from about 0.2 to about 5 percent (percent by weight). Examples of organic soluble initiators include Vazo peroxides, such as VAZO 64™, 2-methyl 2-2'-azobis propanenitrile, and VAZO 88™, 2-2'-azobis isobutyramide dehydrate in a suitable amount, such as in the range of from about 0.1 to about 8 percent. Examples of chain transfer agents include dodecanethiol, octanethiol, carbon tetrabromide, and the like in various suitable amounts, such as in an amount of from about 0.1 to about 10 percent, and more specifically, from about 0.2 to about 5 percent by weight of monomer.

Surfactants for the preparation of latexes and colorant dispersions can be ionic or nonionic surfactants in effective amounts of, for example, from about 0.01 to about 15, or from about 0.01 to about 5 percent by weight of the reaction mixture. Anionic surfactants include sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. Examples of cationic surfactants are dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride) available from Kao Chemicals, and the like, selected in effective amounts of, for example, from about 0.01 percent to about 10 percent by weight. The molar ratio of the cationic surfactant used for flocculation to the anionic surfactant used in the latex preparation is, for example, from about 0.5 to about 4.

Examples of nonionic surfactants selected in various suitable amounts, such as about 0.1 to about 5 percent by weight, are polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™, can be selected.

The following Examples are presented.

Preparation of Sodio Sulfonated Polyesters

A linear sulfonated random copolyester resin comprised of, on a mol percent, 0.465 of terephthalate, 0.035 of sodium sulfoisophthalate, 0.475 of 1,2-propanediol, and 0.025 of diethylene glycol was prepared as follows. In a 5 gallon Parr reactor equipped with a bottom drain valve, double turbine agitator, and distillation receiver with a cold water condenser were charged 3.98 kilograms of dimethylterephthalate, 451 grams of sodium dimethyl sulfoisophthalate, 3.104 kilograms of 1,2-propanediol (1 mole excess of glycol), 351 grams of diethylene glycol (1 mole excess of glycol), and 8 grams of butyltin hydroxide oxide catalyst. The reactor was then heated to 165° C. with stirring for 3 hours whereby 1.33 kilograms of distillate were collected in the distillation receiver, and which distillate was comprised of about 98 percent by volume of methanol and 2 percent by volume of 1,2-propanediol as measured by the ABBE refractometer available from American Optical Corporation. The reactor mixture was then heated to 190° C. over a one hour period, after which the pressure was slowly reduced from atmospheric pressure to about 260 Torr over a one hour period, and then reduced to 5 Torr over a two hour period with the collection of approximately 470 grams of distillate in the distillation receiver, and which distillate was comprised of approximately 97 percent by volume of 1,2-propanediol and 3 percent by volume of methanol as measured by the ABBE refractometer. The pressure was then further reduced to about 1 Torr over a 30 minute period whereby an additional 530 grams of 1,2-propanediol were collected. The reactor was then purged with nitrogen to atmospheric pressure, and the polymer product discharged through the bottom drain onto a container cooled with dry ice to yield 5.60 kilograms of 3.5 mol percent sulfonated polyester resin, sodio salt of (1,2-propylene-dipropylene-5-sulfoisophthalate)-copoly(1,2-propylene-dipropylene terephthalate). The sulfonated polyester resin glass transition temperature was measured to be 56.6° C. (onset) utilizing the 910 Differential Scanning Calorimeter available from E.I. DuPont operating at a heating rate of 10° C. per minute. The number average molecular weight was measured to be 3,250 grams per mole, and the weight average molecular weight was measured to be 5,290 grams per mole using tetrahydrofuran as the solvent.

Preparation of a Sodio Sulfonated Polyester Colloid Solution

A 15 percent solids concentration of a colloidal solution of the above prepared sodio-sulfonated polyester resin particles with particle diameter sizes of from about 5 to about 150 nanometers, and typically about 20 to about 40 nanometers dissipated in 85 percent aqueous media of water was prepared by first heating about 2 liters of deionized water to about 85° C. with stirring, and adding thereto 300 grams of the above prepared sulfonated polyester resin, followed by continued heating at about 85° C., and stirring of the mixture for a duration of from about one to about two hours, followed by cooling to about room temperature, about 25° C. throughout the Examples. The resulting colloidal solution of sodio-sulfonated polyester resin particles possessed a characteristic blue tinge and particle sizes of from about 5 to about 150 nanometers, and typically of about 20 to about 40 nanometers, as measured by the NiCOMP® particle sizer.

COMPARATIVE EXAMPLE 1

(VF173/Control):

A pilot plant batch of toner PP-5695-EAP-4-C34W comprised of the sodio-sulfonated polyester SPE4, 12 percent solids and 88 percent deionized water, 9 percent carnauba wax dispersion and 6 percent by weight of FLEXIVERSE BLUE™ (Pigment Blue 15:3, BFD1121, 47.1 percent solids) dispersion (Sun Chemical Company) was prepared. Aggregation of the cyan polyester toner particles was completed at 58° C. (degrees Centigrade throughout) in a 30 gallon stainless steel reactor (of which only 20 kilograms of the toner yield were used for bench scale studies). The agitation rate was set initially to 100 RPM. A 5 percent zinc acetate solution was added as the coagulant by fast initial zinc addition (FIZA) technique as illustrated in U.S. Pat. No. 6,395,445, the disclosure of which is totally incorporated herein by reference, where 60 to 80 percent of the total zinc acetate solution was added quickly (600 grams/minute for the first 30 minutes) and the remainder (80 to 100 grams/minute thereafter) was added at a reduced rate. The amount of zinc acetate added equaled approximately 11 percent of the total resin in the emulsion. After 7 hours of aggregation, the particle size reached 5.24 μm with a GSD of 1.2. Full cooling was applied and particles were sieved at about 30° C. to about 35° C. through a 25 μm nylon filter bag. A portion of the toner slurry was washed in the lab three times with deionized water after the mother liquor removal, resuspended to approximately 25 percent weight solids and freeze dried for 48 hours to provide the untreated parent toner (VF173 or Control). This toner was comprised of 85 percent sodio-sulfonated polyester, 9 percent carnauba wax dispersion and 6 percent by weight of FLEXIVERSE BLUE™ pigment.

COMPARATIVE EXAMPLE 2

(JC003G/Control):

A pilot plant batch of toner PP-5738-EAP-4-C37 comprised of a sodio-sulfonated polyester (SPE4, 12 percent solids and 88 percent deionized water) and 6 percent by weight of FLEXIVERSE BLUE™ (Pigment Blue 15:3, BFD1121, 47.1 percent solids) dispersion (Sun Chemical Company) was prepared. Aggregation of the cyan polyester particles was completed at 58° C. (degrees Centigrade throughout) in, a 5 gallon stainless steel reactor. The agitation rate was set to 150 RPM. A 3 percent zinc acetate solution was added as the coagulant via FIZA or fast initial zinc addition technique as illustrated in U.S. Pat. No. 6,395,445, the disclosure of which is totally incorporated herein by reference, where 60 to 80 percent of the total zinc acetate solution was added quickly (600 grams/minute for the first 30 minutes) and the remainder (80 to 100 grams/minute thereafter) was added at a reduced rate. The amount of zinc acetate added equaled approximately 12 percent of the total resin in the emulsion. After 8 hours of aggregation, the particle size reached 5.95 μm with a GSD of 1.16. Full cooling was applied and particles were sieved at about 30° C. to about 35° C. through a 25 μm nylon filter bag. A portion of the resulting toner slurry was washed in the lab three times with deionized water after the mother liquor removal, resuspended to approximately 25 percent weight solids and freeze dried for 48 hours to provide the untreated parent toner (JC003G or Control). This toner was comprised of 94 percent sodio-sulfonated polyester and 6 percent by weight of FLEXIVERSE BLUE™ pigment.

EXAMPLE I (VF246):

Preparation of EEPO Solution:

An aminoalkylmethacrylate copolymer EUDRAGIT™ EPO (EEPO), which was delivered as a 1 percent (wt/wt) solution in deionized water (DIW), was prepared by dissolving 1.26 grams of the EEPO in 124.7 grams of 0.3 M $HNO_3$; the pH of the solution was lowered to 2 by adding 2.4 grams of 1 M $HNO_3$. Lowering the pH of the aqueous solution to 2 ensured complete solubility of the EEPO polymer in the solution. The final total percentage of EEPO to toner was about 3 percent weight of dry toner.

Coating Procedure of EEPO onto Surface of Polyester Toner Particles:

The stock pilot plant toner of 85 percent sodio-sulfonated polyester, 9 percent carnauba wax dispersion and 6 percent by weight of FLEXIVERSE BLUE™ pigment (PP-5695-EAP-4-C34W) was treated in the lab via a pH shifting procedure where EEPO is soluble or insoluble in an aqueous solution depending on the pH of the aqueous solution.

A 327 gram quantity of the toner slurry (12.9 percent by weight solids in 87.1 percent mother liquor) comprised of 85 percent of the sodio-sulfonated polyester, 9 percent carnauba wax dispersion and 6 percent by weight of FLEXIVERSE BLUE™ pigment was separated from its mother liquor via decanting, and then stirred in a 1 liter glass Erlenmeyer flask on a stir plate at about 250 to about 300 rpm. The pH of the toner slurry was lowered from about 5.5 to about 2.4 by the addition of 70 grams of 0.3 M $HNO_3$. The EEPO solution was added dropwise to the toner slurry and stirred for 1 hour at room temperature. After 1 hour, the pH of the toner slurry was increased to 12.2 with 71 grams of 1 M NaOH and left to stir at 300 rpm for 18 to 20 hours overnight at ambient temperature. The surface treated toner was then filtered and washed four times. The filtercake was then resuspended to approximately 25 percent by weight solids and freeze dried. The pH of the filtrates were always greater than 9.5 and showed no sign of precipitated EEPO; it can be assumed that all EEPO polymer was transferred to the toner surface. This toner was comprised of 85 percent sodio-sulfonated polyester, 9 percent carnauba wax dispersion and 6 percent by weight of FLEXIVERSE BLUE™ pigment with 3 percent EEPO relative to dry toner weight deposited or coated on the toner's surface.

EXAMPLE II (JC003B-2):

Preparation of EEPO Solution:

An aminoalkylmethacrylate copolymer of EUDRAGIT™ EPO (EEPO), which was delivered as a 1.9 percent (wt/wt) solution in deionized water (DIW), was prepared by dissolving 0.862 gram of the EEPO in 43.10 grams of acidified water (pH=1.42 with nitric acid); the pH of the solution was lowered to 2.12 by adding 2.41 grams of 1 M $HNO_3$. Lowering the pH of the aqueous solution to 2.12 ensured complete solubility of the EEPO polymer in the solution. The total percentage of EEPO to toner was to equal 1 percent weight of dry toner.

Coating Procedure of EEPO onto Surface of Polyester Toner Particles:

The stock pilot plant toner of 94 percent of the sodio-sulfonated polyester and 6 percent by weight of FLEXIVERSE BLUE™ pigment (PP-5738-EAP-4-C37) was treated in the lab via a pH shifting procedure where EEPO was soluble or insoluble in an aqueous solution depending on the pH of the aqueous solution.

A 570.1 gram quantity of the toner slurry (15.1 percent-weight solids in 84.9 percent mother liquor) of 94 percent sodio-sulfonated polyester and 6 percent by weight of FLEXIVERSE BLUE™ pigment was separated from its mother liquor via decanting, and then stirred in a 1 liter glass Erlenmeyer flask on a stir plate at 450 rpm. The pH of the toner slurry was lowered from about 5.48 to about 2.49 by the addition of 65.2 grams of 0.5 M $HNO_3$. The EEPO solution was added via a low flow VWR peristaltic pump at a rate of 1.08 grams per minute (or a total time of 42 minutes) to the toner slurry at room temperature. The toner was then stirred for an hour at room temperature after the addition of EEPO. After the one hour of stirring, the pH of the toner slurry was increased to 11.28 with 64.23 grams of 1 M NaOH and left to stir at 450 rpm for another hour. The toner was then left to sit overnight at ambient temperature. Thereafter, the surface treated toner was then filtered and washed two times. The filtercake was then resuspended to approximately 25 percent by weight solids and freeze dried. The pH of the filtrates were usually greater than 7.5 and evidenced no sign of precipitated EEPO; it can thus be assumed that all EEPO polymer was transferred to the toner surface. The resulting toner was comprised of 94 percent of the above sodio-sulfonated polyester and 6 percent by weight of FLEXIVERSE BLUE™ pigment with 1 percent EEPO relative to the dry toner weight deposited or coated on the toner surface.

EXAMPLE III (JC003C-2):

Preparation of EEPO Solution:

An aminoalkylmethacrylate copolymer of EUDRAGIT™ EPO (EEPO), which was delivered as a 1.9 percent (wt/wt) solution in deionized water (DIW), was prepared by dissolving 2.59 grams of the EEPO in 129.50 grams of acidified water (pH=1.42 with nitric acid); the pH of the solution was lowered to 2.23 by adding 4.61 grams of 1 M $HNO_3$. Lowering the pH of the aqueous solution to 2.2 ensured complete solubility of the EEPO polymer in the solution. The total percentage of EEPO to toner was to equal 3 percent weight of dry toner.

Coating Procedure of EEPO onto Surface of Polyester Toner Particles:

The stock pilot plant toner of 94 percent sodio-sulfonated polyester and 6 percent by weight of FLEXIVERSE BLUE™ pigment (PP-5738-EAP-4-C37) was treated in the lab via a pH shifting procedure where EEPO was soluble or insoluble in an aqueous solution depending on the pH of the aqueous solution.

A 570.9 gram quantity of the toner slurry (15.1 percent by weight solids in 84.9 percent mother liquor) of 94 percent of the above sodio sulfonated polyester and 6 percent by weight of FLEXIVERSE BLUE™ pigment was separated from its mother liquor via decanting, and then stirred in a 1 liter glass Erlenmeyer flask on a stir plate at 450 rpm. The pH of the toner slurry was lowered from about 5.54 to about 2.42 by the addition of 67.6 grams of 0.5 M $HNO_3$. The EEPO solution was added via a low flow VWR peristaltic pump at a rate of 1.38 grams per minute (or a total time of 97 minutes) to the toner slurry at room temperature. The toner was then stirred for an extra hour at room temperature after the addition of EEPO. Subsequent to one hour of stirring, the pH of the toner slurry was increased to 11.26 with 68.45 grams of 1 M NaOH and left to stir at 450 rpm for another hour. The toner was then retained overnight at ambient temperature, then the surface treated toner was filtered and washed three times. The filtercake resulting was then resuspended to approximately 25 percent by weight solids and freeze dried. The pH of the filtrates were greater than 7.5 and showed no sign of precipitated EEPO; it is believed that all EEPO polymer was transferred to the toner surface. The resulting toner was comprised of 94 percent of the sodio-sulfonated polyester and 6 percent by weight of FLEXIVERSE BLUE™ pigment with 3 percent EEPO relative to dry toner weight deposited or coated on the toner's surface.

EXAMPLE IV (JC003E):

Preparation of EEPO Solution:

An aminoalkylmethacrylate copolymer of EUDRAGIT™ EPO (EEPO), which was delivered as a 1.9 percent (wt/wt) solution in deionized water (DIW), was prepared by dissolving 3.682 grams of the EEPO in 184.10 grams of acidified water (pH=1.42 with nitric acid); and the pH of the solution was lowered to 2.25 by adding 9.31 grams of 1 M $HNO_3$. Lowering the pH of the aqueous solution to 2.2 ensured complete solubility of the EEPO polymer in the solution. The total percentage of EEPO to toner was to equal 7 percent weight of dry toner.

Coating Procedure of EEPO onto Surface of Polyester Toner Particles:

The stock pilot plant toner of 94 percent sodio-sulfonated polyester and 6 percent by weight of FLEXIVERSE BLUE™ pigment (PP-5738-EAP-4-C37) was treated in the lab via a pH shifting procedure where EEPO was soluble or insoluble in an aqueous solution depending on the pH of the aqueous solution.

A 522.46 gram quantity of the toner slurry (10.1 percent by weight solids in 89.9 percent mother liquor) of 94 percent of the above sodio-sulfonated polyester and 6 percent by weight of FLEXIVERSE BLUE™ pigment was separated from its mother liquor via decanting, and then stirred in a 1 liter glass Erlenmeyer flask on a stir plate at 450 rpm. The pH of the toner slurry was lowered from about 5.62 to about 2.45 by the addition of 72.7 grams of 0.5 M $HNO_3$. The EEPO solution was added via a low flow VWR peristaltic pump at a rate of 1.19 grams per minute (or a total time of 162 minutes) to the toner slurry at room temperature. The toner was then stirred for an extra hour at room temperature after the addition of EEPO. Subsequent to one hour of stirring, the pH of the toner slurry was increased to 11.27 with 97.2 grams of 1 M NaOH and left to stir at 450 rpm for another hour. The toner was retained overnight at ambient temperature; then the surface-treated toner was filtered and washed two times. The filtercake resulting was then resuspended to approximately 25 percent by weight solids and freeze-dried. The pH of the filtrates was greater than 7.9 and showed no sign of precipitated EEPO; it is believed that all EEPO polymer was transferred to the toner surface. The resulting toner was comprised of 94 percent of the sodio-sulfonated polyester and 6 percent by weight of FLEXIVERSE BLUE™ pigment with 7 percent EEPO relative to dry toner weight deposited or coated on the toner's surface.

EXAMPLE V (JC026A):

Preparation of EEPO Solution:

An aminoalkylmethacrylate copolymer of EUDRAGIT™ EPO (EEPO), which was delivered as a 1.9 percent (wt/wt) solution in deionized water (DIW), was prepared by dissolving 2.67 grams of the EEPO in 133.47 grams of acidified water (pH=1.43 with nitric acid); the pH of the solution was lowered to 2.05 by adding 5.32 grams of 1 M $HNO_3$. Lowering the pH of the aqueous solution to 2 ensured complete solubility of the EEPO polymer in the solution. The total percentage of EEPO to toner was to equal 5 percent by weight of dry toner.

Coating Procedure of EEPO onto Surface of Polyester Toner Particles:

The stock pilot plant toner of 85 percent sodio-sulfonated polyester, 9 percent carnauba wax dispersion and 6 percent by weight of black REGAL 330®, FLEXIVERSE™ pigment (PP-6073-EAP-R5-K6W) was treated in the lab via a pH shifting procedure where EEPO is soluble or insoluble in an aqueous solution depending on the pH of the aqueous solution.

A 325.15 gram quantity of the toner slurry (16.4 percent by weight solids in 83.6 percent mother liquor) of 85 percent of the above sodio-sulfonated polyester, 9 percent carnauba wax dispersion and 6 percent by weight of black REGAL 330®, FLEXIVERSE™ pigment was separated from its mother liquor via decanting, and then stirred in a 1 liter glass Erlenmeyer flask on a stir plate at 450 rpm. The pH of the toner slurry was lowered from about 5.62 to about 2.15 by the addition of 43.75 grams of 0.5 M $HNO_3$. The EEPO solution was added via a low flow VWR peristaltic pump at a rate of 1.36 grams per minute (or a total time of 102 minutes) to the toner slurry at room temperature. The toner was then stirred for an extra hour at room temperature after the addition of EEPO. Subsequent to one hour of stirring, the pH of the toner slurry was increased to 11.33 with 51.09 grams of 1 M NaOH and left to stir at 450 rpm for another hour. The toner was then retained overnight at ambient temperature; then the surface treated toner was then filtered and washed three times. The filtercake resulting was then resuspended to approximately 25 percent by weight solids and freeze dried. The pH of the filtrates was always greater than 7.5 and showed no sign of precipitated EEPO; and it is believed that all EEPO polymer was transferred to the toner surface. The resulting toner was comprised of 85 percent of the sodio-sulfonated polyester, 9 percent carnauba wax dispersion and 6 percent by weight of black REGAL 330®, FLEXIVERSE™ pigment with 5 percent EEPO relative to dry toner weight deposited or coated on the toner's surface.

EXAMPLE VI (JC026D):

Preparation of EEPO Solution:

An aminoalkylmethacrylate copolymer of EUDRAGIT™ EPO (EEPO), which was delivered as a 1.9 percent (wt/wt) solution in deionized water (DIW), was prepared by dissolving 5.34 grams of the EEPO in 266.83 grams of acidified water (pH=1.43 with nitric acid); the pH of the solution was lowered to 2.05 by adding 8.38 grams of 1 M $HNO_3$. Lowering the pH of the aqueous solution to 2 ensured complete solubility of the EEPO polymer in the solution. The total percentage of EEPO to toner was to equal 10 percent weight of dry toner.

Coating Procedure of EEPO onto Surface of Polyester Toner Particles:

The stock pilot plant toner of 85 percent sodio-sulfonated polyester, 9 percent carnauba wax dispersion and 6 percent by weight of black REGAL 330®, FLEXIVERSE™ pigment (PP-6073-EAP-R5-K6W) was treated in the lab via a pH shifting procedure where EEPO was soluble or insoluble in an aqueous solution depending on the pH of the aqueous solution.

A 325.01 gram quantity of the toner slurry (16.4 percent by weight solids in 83.6 percent mother liquor) of 85 percent of the above sodio-sulfonated polyester, 9 percent carnauba wax dispersion and 6 percent by weight of black REGAL 330®, FLEXIVERSE™ pigment was separated from its mother liquor via decanting, and then stirred in a 1 liter glass Erlenmeyer flask on a stir plate at 450 rpm. The pH of the toner slurry was lowered from 5.58 to 2.05 by the addition of 44.83 grams of 0.5 M $HNO_3$. The EEPO solution was added via a low flow VWR peristaltic pump at a rate of 1.46 grams per minute (or a total time of 188 minutes) to the toner slurry at room temperature. The toner was then stirred for an extra hour at room temperature after the addition of EEPO. Subsequent to one hour of stirring, the pH of the toner slurry was increased to 11.43 with 62.36 grams of 1 M NaOH and left to stir at 450 rpm for another hour. The toner was then retained overnight at ambient temperature; then the surface treated toner was filtered and washed three times. The filtercake resulting was then resuspended to approximately 25 percent by weight solids and freeze dried. The pH of the filtrates were always greater than 7.9 and showed no sign of precipitated EEPO; it is believed that all EEPO polymer was transferred to the toner surface. The resulting toner was comprised of 85 percent of the sodio-sulfonated polyester, 9 percent carnauba wax dispersion and 6 percent by weight of black REGAL 330®, FLEXIVERSE™ pigment with 10 percent EEPO relative to dry toner weight deposited or coated on the toner's surface.

Triboelectric Charging Evaluation of Preliminary Cyan Toners:

The data in Table 1 highlights the triboelectric charging results for the four preliminary EA (Emulsion/Aggregation) polyester toner samples, three of which were surface-treated with EEPO with the other two being the untreated parent toners (control samples). The opposite sign triboelectric charge levels were observed in all three treated toners in both the A-zone or 28° C./85 percent relative humidity (RH) zone and the C-zone or 10° C./15 percent relative humidity (RH) zone. The carrier used for the parent toner measurements was a 35 micron solution coated carrier designated EFC35B with 1.62 percent by weight of a composite of a polymer of a crosslinking acrylic resin (THERMOLAC™ RF-17), 0.17 percent by weight of carbon black (VULCAN™ 72) and 0.20 percent by weight of melamine-formaldehyde resin powder (EPOSTAR™ S). The toners were mixed with the carrier and conditioned overnight (about 18 hours) at 15 percent and 85 percent RH and charged for 60 minutes using a Turbula mixer. The toner concentration in the developer was 5 parts per hundred. Triboelectric charge was measured using a charge spectrograph. The number assigned for the charge represents the midpoint of the charge distribution in millimeters displacement from the zero charge line. A desired triboelectric charge for both the A (the charge levels at 85 percent RH) and C-zone (the charge levels at 15 percent RH) is about 4 to about 20 $\mu$C/grams while the RH ratio for the toner would be equal to or greater than about 0.4. Preliminary results indicated excellent toner charge reversal from negative to positive triboelectric charge.

The triboelectric charging results for the nontreated toners and EEPO surface treated toners are shown in Table 1. The surface treated toners exhibited up to a 4 $\mu$C/grams charge reversal in the charge levels at 85 percent RH and up to 16 $\mu$C/grams charge reversal in the charge levels at 15 percent RH, thereby causing the RH sensitivity (the ratio of charge level at 85 percent RH versus 15 percent RH) to improve by a factor of 6 to 11.

TABLE 1

Tribocharging Results For Preliminary Experiments of Toners Surface Coated With EUDRAGIT ™ EEPO and Their Corresponding Controls

| Toner ID | EEPO Surface Treatment | q/m, $\mu$Coul/g (85 percent RH) | q/m, $\mu$Coul/g (15 percent RH) | q/m RH ratio |
|---|---|---|---|---|
| VF173 | None | −0.67 | −20.6 | 0.03 |
| VF231 | None | −1.22 | −19.1 | 0.06 |
| VF246 | 3 percent EEPO | +4.41 | +12.8 | 0.34 |
| VF261 | 3 percent EEPO | +3.08 | +14.4 | 0.21 |
| VF258 | 3 percent EEPO | +3.08 | +15.9 | 0.19 |

Triboelectric Charging Data:

The data presented in Table 2 highlights the opposite sign triboelectric charge levels, in both the 15 percent and 85 percent RH zone, and RH ratio for toners in Examples I through VI treated with various levels of EEPO, compared to the reference toner VF173 and JC003G of the Comparative Examples 1 and 2. The opposite sign triboelectric charge levels are illustrated in all six treated toners, in both the A-zone or 28° C./85 percent relative humidity (RH) zone and the C-zone or 10° C./15 percent relative humidity (RH) zone. The carrier used for the parent toner measurements was a 35 micron solution coated carrier designated EFC35B with 1.434 percent by weight of a composite of a polymer of crosslinking acrylic resin (THERMOLAC™ RF-17), 0.366 percent by weight of carbon black (VULCAN™ 72) and 0.200 percent by weight of melamine-formaldehyde resin powder (EPOSTAR™ S). The toners were mixed with the carrier and conditioned overnight (about 18 hours) at 15 percent and 85 percent RH and charged for 60 minutes using a Turbula mixer. The toner concentration in the developer was 5 parts per hundred. Triboelectric charge was measured using a charge spectrograph. The number assigned for the charge represents the midpoint of the charge distribution in millimeters displacement from the zero charge line. The desired triboelectric charge for both the A (the charge levels at 85 percent RH) and C-zone (the charge levels at 15 percent RH) was about 4 to about 20 $\mu$C/grams; while the desired A/C or RH ratio for the toner is equal to or greater than 0.4. Preliminary results indicated excellent charge reversal from negative to positive triboelectric charging. The triboelectric charging results for the nontreated toners and EEPO surface treated toners are shown in Table 2. The surface treated toners exhibited up to a 5 $\mu$C/gram charge reversal in the charge levels at 85 percent RH and up to 20 $\mu$C/gram charge reversal in the charge levels at 15 percent RH, thereby causing the RH sensitivity (the ratio of charge level at 85 percent RH versus 15 percent RH) to improve by a factor of about 2 to about 7.

TABLE 2

Tribocharging Results of Toners Surface Coated With EEPO and Their Non-Treated Counterparts

| Toner ID | EEPO Surface Treatment | q/m, $\mu$Coul/g (85 percent RH) | q/m, $\mu$Coul/g (15 percent RH) | q/m RH ratio |
|---|---|---|---|---|
| Comparative Example 1 (VF173) | None | −1.8 | −26.4 | 0.07 |
| Comparative Example 2 (JC003G) | None | −1.1 | −15.6 | 0.07 |
| Example I (VF246) | 3 percent EEPO | +5.1 | +12.4 | 0.41 |
| Example II (JC003B-2) | 1 percent EEPO | +1.5 | +12.2 | 0.12 |
| Example III (JC003C-2) | 3 percent EEPO | +2.0 | +12.9 | 0.16 |
| Example IV (JC003E) | 7 percent EEPO | +2.8 | +20.6 | 0.14 |
| Example V (JC026A) | 5 percent EEPO | +2.5 | +7.1 | 0.35 |
| Example VI (JC026D) | 10 percent EEPO | +3.1 | +6.4 | 0.48 |

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A toner process comprising heating a mixture of a latex and a colorant, which heating is accomplished below about the glass transition temperature, Tg, of polymer contained in the latex; cooling; and subsequently adding a methacrylate polymer solution; adjusting the pH of the mixture resulting to permit the methacrylate polymer to precipitate on said mixture of latex and said colorant.

2. A process in accordance with claim 1 wherein said latex contains a polyester polymer, and wherein the pH is adjusted to about 7.

3. A process in accordance with claim 2 wherein said latex contains a sulfonated polyester, and wherein the pH is adjusted to about 7.

4. A process in accordance with claim 1 wherein said latex polymer is a polyester of the formula

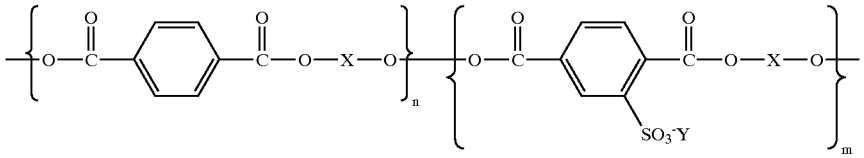

wherein Y is an alkali metal, X is a glycol, and n and m each represent the number of segments.

5. A process in accordance with claim 4 wherein said polyester resin is poly(1,2-propylene-sodio 5-sulfoisophthalate).

6. A process in accordance with claim 4 wherein said polyester resin is polyneopentylene-sodio 5-sulfoisophthalate polyester.

7. A process in accordance with claim 4 wherein said alkali metal is sodium, or potassium.

8. A process in accordance with claim 4 wherein said glycol is an alkylene glycol.

9. A process in accordance with claim 8 wherein said glycol is an aliphatic glycol of neopentyl glycol, ethylene glycol, propylene glycol, butylene glycol, pentylene glycol, propanediol, 1,2-propanediol, diethylene glycol, dipropylene glycol, or optionally mixtures thereof.

10. A process in accordance with claim 4 wherein said m and said n each represent a number of from about 10 to about 30.

11. A process in accordance with claim 4 wherein the weight average molecular weight ($M_w$) of said polyester is from about 2,000 grams per mole to about 100,000 grams per mole, the number average molecular weight ($M_n$) is from about 1,000 grams per mole to about 50,000 grams per mole, and the polydispersity thereof is from about 2 to about 18 as measured by gel permeation chromatography.

12. A process in accordance with claim 1 wherein said methacrylate is a butylmethacrylate-(2-dimethylaminoethyl) methacrylate/methylmethacrylate copolymer.

13. A process in accordance with claim 12 wherein said polymer ratio of said segments is 1:2:1.

14. A process in accordance with claim 13 wherein said polymer ratio is about 25 percent:50 percent:25 percent; about 33 percent:33 percent:33 percent; about 0 percent:25 percent:75 percent; or about 0 percent:0 percent:100 percent.

15. A process in accordance with claim 1 wherein said methacrylate is a butylmethacrylate-(2-dimethylaminoethyl) methacrylate-methylmethacrylate copolymer (1:2:1) containing (2-dimethylaminoethyl) methacrylate, butyl methacrylate and methyl methacrylate with a mean molecular weight, $M_w$ of from about 125,000 to about 175,000.

16. A process in accordance with claim 1 wherein said methacrylate is present in an amount of from about 1 to about 10 percent by weight.

17. A process in accordance with claim 1 wherein said methacrylate is present in an amount of from about 3 to about 7 percent by weight.

18. A process in accordance with claim 1 wherein said methacrylate is a butylmethacrylate-(dimethylaminoethyl methacrylate/methylmethacrylate copolymer present in an amount of from about 1 to about 10 percent by weight.

19. A process in accordance with claim 1 wherein said methacrylate is a butylmethacrylate-(dimethylaminoethyl) methacrylate/methylmethacrylate copolymer present in an amount of from about 3 to about 7 percent by weight.

20. A process in accordance with claim 1 wherein said pH is from about 8 to about 12.

21. A process in accordance with claim 1 wherein said pH above 7 is from about 10 to about 11.

22. A process in accordance with claim 1 wherein the pH of the resulting mixture after heating is from about 2 to about 5, and which pH is increased to from about 9 to about 12 subsequent to the addition of said methacrylate.

23. A process in accordance with claim 22 wherein the pH is increased by the addition of a base.

24. A process in accordance with claim 23 wherein the base is an alkali metal hydroxide.

25. A process in accordance with claim 23 wherein the base is sodium hydroxide.

26. A process in accordance with claim 1 wherein the pH of the resulting mixture after heating is from about 2 to about 4 and which pH is increased to from about 10 to about 12 subsequent to the addition of said methacrylate.

27. A process in accordance with claim 1 further including adding a wax to said latex and said colorant mixture.

28. A process in accordance with claim 27 wherein said wax a polypropylene, a polyethylene, or mixtures thereof.

29. A process in accordance with claim 27 wherein said wax is a polyethylene.

30. A process in accordance with claim 27 wherein said wax possesses a low weight average molecular weight $M_w$ of from about 1,000 to about 20,000.

31. A process in accordance with claim 1 wherein there is further included a coagulant.

32. A process in accordance with claim 1 wherein there is further included a coagulant of zinc acetate.

33. A process in accordance with claim 1 wherein said heating is from about 35° C. to about 55° C.

34. A process in accordance with claim 1 further including a second heating above the latex resin Tg subsequent to said addition of said methacrylate polymer.

35. A process in accordance with claim 34 wherein said heating is from about 70° C. to about 95° C. and wherein coalescence results for said latex resin, said colorant and said methacrylate, and which methacrylate is present on the surface of said resulting toner.

36. A process in accordance with claim 35 wherein said polymer is present in an amount of from about 80 to about 98 percent by weight, and said colorant is present in an amount of from about 2 to about 20 percent by weight of the toner.

37. A process in accordance with claim 1 wherein the colorant is a pigment.

38. A process in accordance with claim 1 wherein said latex polymer is selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly (styrene-butyl acrylate-acrylononitrile-acrylic acid).

39. A process in accordance with claim 1 wherein the colorant is carbon black, cyan, yellow, magenta, or mixtures thereof, and the toner resulting is from about 2 to about 25 microns in volume average diameter, and wherein there is optionally added to the surface of the formed toner metal salts, metal salts of fatty acids, silicas, metal oxides, or mixtures thereof, each in an amount of from about 0.1 to about 10 percent by weight of the obtained toner.

40. A toner process comprising heating a mixture of a latex and a colorant, which heating is accomplished below about the glass transition temperature, Tg, of polymer contained in the latex; cooling; and subsequently adding a methacrylate polymer solution; adjusting the pH of the mixture resulting to permit the methacrylate polymer to precipitate on said mixture of latex and said colorant; and wherein resulting product is heated above about the glass transition temperature, Tg, of said latex polymer.

41. A toner process comprising heating a mixture of a latex and a colorant, which heating is accomplished below about the glass transition temperature, Tg, of polymer contained in the latex; cooling; and subsequently adding a methacrylate polymer solution; adjusting the pH of the mixture resulting to permit said methacrylate to form on said mixture of said latex and said colorant; and wherein resulting product is heated above about the glass transition temperature, Tg, of said latex polymer.

* * * * *